US005610589A

United States Patent [19]

Evans et al.

[11] Patent Number: 5,610,589

[45] Date of Patent: Mar. 11, 1997

[54] METHOD AND APPARATUS FOR ENFORCING HYGIENE

[75] Inventors: Bennie R. Evans, 101 W. Lake Dr., Medicine Park, Okla. 73557; Walter D. Ballew, Midwest City, Okla.

[73] Assignee: Bennie R. Evans, Medicine Park, Okla.

[21] Appl. No.: 385,608

[22] Filed: Feb. 9, 1995

[51] Int. Cl.[6] ..... G08B 23/00

[52] U.S. Cl. ..... 340/573; 340/632

[58] Field of Search ..... 340/573, 540, 340/541, 825.31, 825.32, 555, 556, 632; 73/23.2, 23.34, 19.1; 40/1.6, 463

[56] References Cited

U.S. PATENT DOCUMENTS

| | | | |
|---|---|---|---|
| 3,725,895 | 4/1973 | Haynes | 340/572 |
| 3,967,478 | 7/1976 | Guinn | 70/144 |
| 4,045,997 | 9/1977 | Showalter et al. | 73/23.2 |
| 4,297,689 | 10/1981 | Shaw et al. | 340/632 |
| 4,598,275 | 7/1986 | Ross et al. | 340/573 |
| 4,603,326 | 7/1986 | Freed | 340/572 |
| 4,655,235 | 4/1987 | Scott, Jr. | 134/99.1 |
| 4,665,385 | 5/1987 | Henderson | 340/539 |
| 4,682,155 | 7/1987 | Shirley | 340/573 |
| 4,684,933 | 8/1987 | Dill | 340/572 |
| 4,896,144 | 1/1990 | Bogstad | 340/691 |
| 4,964,309 | 10/1990 | Jenkins | 73/864.81 |
| 5,023,597 | 6/1991 | Salisbury | 340/572 |
| 5,202,666 | 4/1993 | Knippscheer | 340/573 |

FOREIGN PATENT DOCUMENTS

| | | | |
|---|---|---|---|
| 300886 | 12/1990 | Japan | 340/540 |
| 1333060 | 10/1973 | United Kingdom . | |
| 2265038 | 9/1993 | United Kingdom | 340/825.32 |
| 5965 | 5/1990 | WIPO | 340/825.31 |
| 9213327 | 8/1992 | WIPO . | |
| 28525 | 12/1994 | WIPO | 340/632 |

*Primary Examiner*—Thomas Mullen
*Attorney, Agent, or Firm*—Dunlap & Codding, P.C.

[57] ABSTRACT

A system of hygienic control employing a name tag to be attached to each worker in a hygienically controlled area. Each name tag has a clear signaling light source thereon indicating the worker is sanitary, and an unsanitary signaling light source thereon indicating the worker has not practiced the proper sanitation procedures. The unsanitary light source is enabled when the worker enters a sanitation area, such as a rest room, and is disabled when the worker has washed his/her hands with soap and water. Also, the clear signaling light source is enabled when the worker has complied with the proper sanitation procedure.

30 Claims, 3 Drawing Sheets

METHOD AND APPARATUS FOR ENFORCING HYGIENE

FIELD OF THE INVENTION

This invention relates to improvements in methods and apparatus for enforcing hygiene.

BACKGROUND OF THE INVENTION

The dangers of unclean practices in restaurants and hospitals have been well known for many years. Bacteria and other microbial organisms which are the cause of many contagious diseases are capable of being transmitted from infected individuals to many other people if sanitary conditions are not maintained in such settings where the micro-organisms thrive and where people are susceptible to receiving into their bodies such microbial micro-organisms.

At the present time, many diseases, such as hepatitis, have been found to be transmittable due to a failure of people to wash their hands with soap and water after using a public toilet. In fact, some public health laws require those in the food distribution field to wash their hands each time they enter the toilet facilities before they resume their duties.

In the main, the requirement for employees to wash their hands is attempted by the posting of signs and/or intermittent checks by supervisory personnel.

Some efforts to produce systems for enforcing hygienic practices in such facilities as restaurants and hospitals have been proposed. However, known prior systems have relied on such tools as audible signals to workers who exit a toilet facility without having done such things as turn on a water faucet or operate a hand drying apparatus. Such systems do not assure that the worker has washed his or her hands with soap and water and can be easily circumvented.

SUMMARY OF THE INVENTION

The present invention provides a system and method for requiring workers in a hygienically controlled area to wash their hands with soap and water before exiting an associated sanitation area. A name tag is provided for each worker which has both a clear signaling light and an unsanitary signaling light source thereon. The unsanitary signaling light is enabled when the worker wearing the name plate enters the sanitation area and is not disabled until the worker has washed his/her hands with soap and water. When such washing has been completed, the clear signaling light is enabled.

The means for enabling the unsanitary signaling light when the worker enters the sanitation area is preferably accomplished with a digitally encoded radio frequency transmitter to reduce the possibility of an accidental enabling of the unsanitary signaling light in a regular working area.

The means for disabling the unsanitary signaling light is preferably accomplished by using an infrared transmitter, the signals from which can be received by a receiver on the name tag within a limited distance from the transmitter. This transmitter is preferably enabled by a detector associated with a hand dryer in the sanitation area. The detector is preferably responsive to a certain range of dilution of a detectable gas being emitted from the soap mixture as the workers' hands are being dried. By providing a limited range of dilution sensitivity, circumvention of the system will be difficult.

DESCRIPTION OF PREFERRED EMBODIMENTS

System Overview

Figure 1:
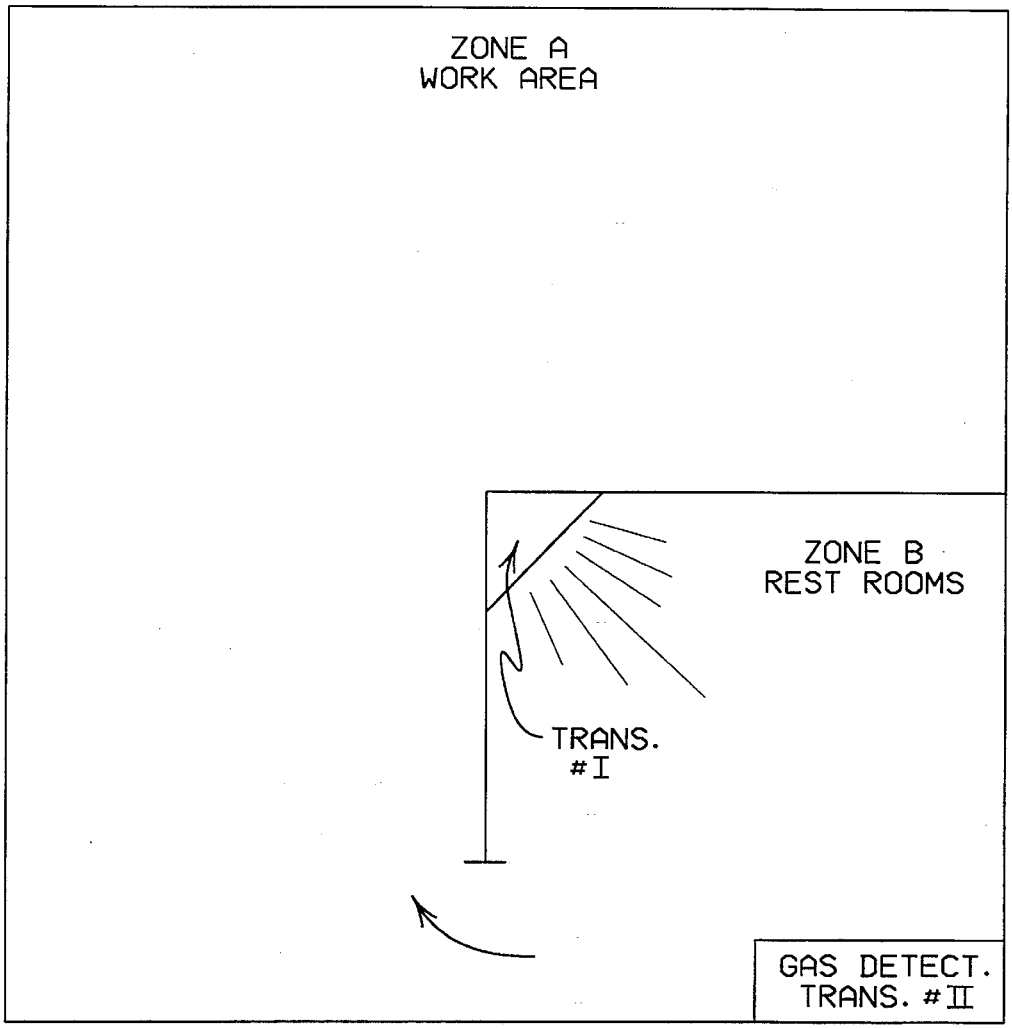
FIG. 1 is a typical layout of a work area with rest rooms.

People required to work (FIG. 1) in a hygienically controlled area (A) will wear a name tag. This name tag will indicate at all times whether the person has followed sanitary health habits as determined, for example, by statutes (i.e. Oklahoma Sate Department of Health under Section 3-201). The name tag shall contain circuitry to allow a green light emitting diode (a clear signaling light) to flash approximately one half second every ten seconds to indicate that the person is following correct procedures. Two zones, Zone A indicating the person's normal working area, and Zone B described as the rest room or designated area for practicing sanitary health habits (sanitation area), shall be established. When the person enters Zone B, the name tag shall flash a red light emitting diode (an unsanitary signaling light) approximately one second every ten seconds as a result of a digitally encoded radio frequency transmitter (Transmitter #I) mounted in Zone B and triggered by the door. After washing with a special soap mixture which will contain a dilute concentration of alcohol, a gas detector associated with the hand dryer will enable an infrared transmitter (Transmitter #II). The transmitter II will cause the name tag to return to the safe (green flashing light emitting diode) condition.

The system is comprised of three specific components:

1.) a name tag with an infrared receiver, a radio frequency receiver and digital control logic.

2.) a radio frequency transmitter (digitally encoded) which can be triggered at a predetermined interval.

3.) a hand dryer equipped with an infrared transmitter which can be triggered by an alcohol detector which registers concentration levels in the "safe region" and is inhibited when the concentration level is above or below the "safe region" concentration.

DETAILED DESCRIPTION

Figure 2:
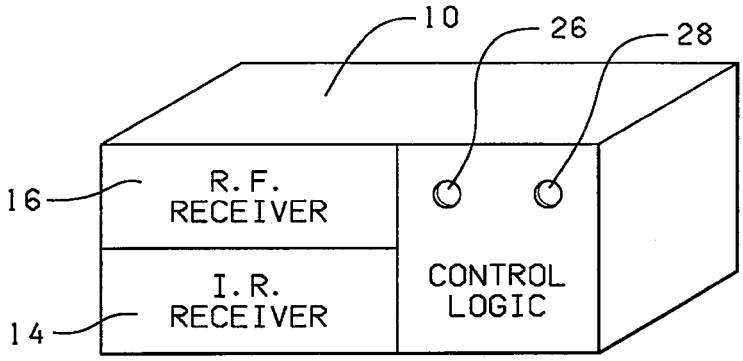
FIG. 2 is a schematic illustration of a name tag which will be worn by each person to be monitored.
Figure 3:
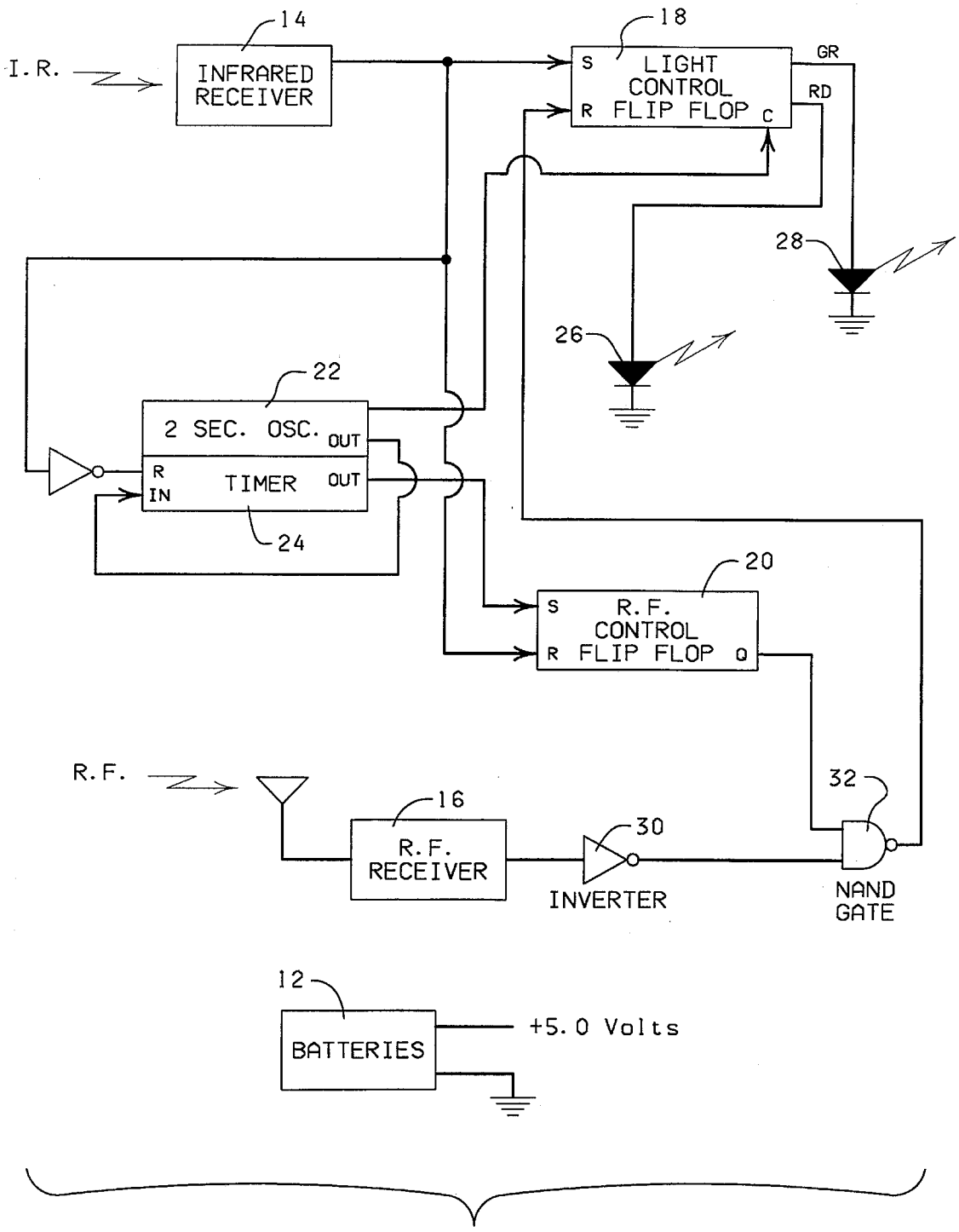
FIG. 3 is a block diagram of the electrical/electronic components contained in a name tag.

The name tag and associated high level block diagram is shown in FIGS. 2 and 3. The actual name tag 10 may be, for example, 3" wide×1 ¼" high×½" deep. The name tag can be powered by batteries 12 (FIG. 3) or solar power depending upon the application. The name tag 10 contains surface mount electronic devices, both discrete and integrated silicon, which allow several thousand equivalent digital logic gates, as well as analog circuitry to be contained in a very small area.

The block diagram (FIG. 3) shows two receivers. One 14 is an infrared receiver capable of detecting an infrared transmitted signal at distances from, for example, zero to twenty feet. The other receiver 16 is a radio frequency type. Due to the very short antenna arrangement on the name tag 10 itself, the receiver 16 has a limited range of, for example, fifty to one hundred feet. This is actually desirable since Zone B is actually much smaller than this in practice. Also, the R.F. transmitter power level (Transmitter #I) will be controlled to avoid false triggering of the receiver 16 when the person is in Zone A. Two control flip flops, 18 and 20, one counter 22, and one timer 24 are all included in the name tag 10 as part of the digital logic. The digital logic provides the following:

1.) a two second oscillator 22 which provides a clock to gate all digital signals.

2.) a timer which disables the R.F. receiver 16 on the name tag 10 for approximately 15 to 30 seconds after the infrared receiver 14 has detected a signal. This allows the person a reasonable time to leave Zone B without allowing the R.F. receiver 16 to detect a newly transmitted signal.

3.) a control flip flop 18 which determines whether the red 26 or green 28 light emitting diode will flash.

4.) a control flip flop 20 which disables the R.F. receiver 16 until the timer 24 determines it is appropriate for the receiver to function again.

Name Tag Operation

The name tag 10 contains its own power supply 12, such as 4 each 1.25 volt nickel cadmium batteries, which provides 5.0 volts. This power supply can be recharged as necessary by either solar cells or from a more conventional source, 115 V.A.C. All circuitry, where possible, is CMOS (Complimentary Metal Oxide Semiconductor) to minimize the power consumption and prolong battery life. When the name tag 10 is powered on by pinning the tag on the person, infrared receiver 14, a radio frequency receiver 16, and necessary digital logic (18, 20, 22 and 24) is activated.

Upon powering on the name tag 10 the first time, the light control flip flop 18 is reset, therefore, the red light emitting diode 26 is blinking. This insures that the person must begin the work period by practicing sanitary health habits. When the infrared receiver 14 detects a transmitted infrared signal the light control flip flop 18 is set and the green light emitting diode 28 will begin blinking on approximately 1/10th of a second every two seconds. This timing control signal is generated by a two second oscillator 22 which generates a 100 millisecond strobe every two seconds. This signal is fed to the control lead (C), of light control flip flop 18 which enables the output of the light control flip flop 18.

When the person enters Zone B, the radio frequency transmitter I is triggered by, for example, a door activated magnetic switch as will be discussed below. The radio frequency receiver 16 intercepts the digitally encoded R.F. carrier and sends a logic low to an inverter, 30, which is nanded with the output of the R.F. control flip flop 20, in the nand gate 32. If the R.F. control flip flop 20 has been set by the timer 24 out line then the hand gate, 32, is enabled and a logic low will reset the light control flip flop 18. When the light control flip flop 18 is reset, the red light emitting diode 26 will turn on approximately 100 milliseconds every two seconds. The red light emitting diode 26 will continue to blink until an infrared carrier is received by the infrared receiver 14. At that time the light control flip flop is set and the green light emitting diode 28 is allowed to blink at the previously mentioned duty cycle. However, the output of the infrared receiver 14 is also routed to the reset line of the timer 24 which will allow the timer to count the output pulses of the two second oscillator 22. The same infrared output signal is routed to the reset line of the R.F. control flip flop 20. This will cause the Q output to become a logic low, thus disabling the nand gate 32, so that any radio frequency signals received will not reset the light control flip flop 18. The radio frequency signals will remain disabled until the timer out signal from timer 24 goes to a logic low at the end of the timer counting sequence of approximately twenty to thirty seconds (adjustable for a given situation). At that time the R.F. control flip flop 20 is set and the Q output goes to a logic high. The nand gate 32 is once again enabled, thus allowing R.F. signals to reset the light control flip flop 18 when R.F. signals are received by receiver 16. This feature allows a person in Zone B who has properly followed the sanitary health habits, approximately thirty seconds to casually exit Zone B before the name tag 10 will be affected by transmitter #I in Zone B. Thus, the unsanitary signaling light 26 will remain disabled, and the clear signaling light 28 will remain enabled when the person re-enters the work area A.

Figure 4:
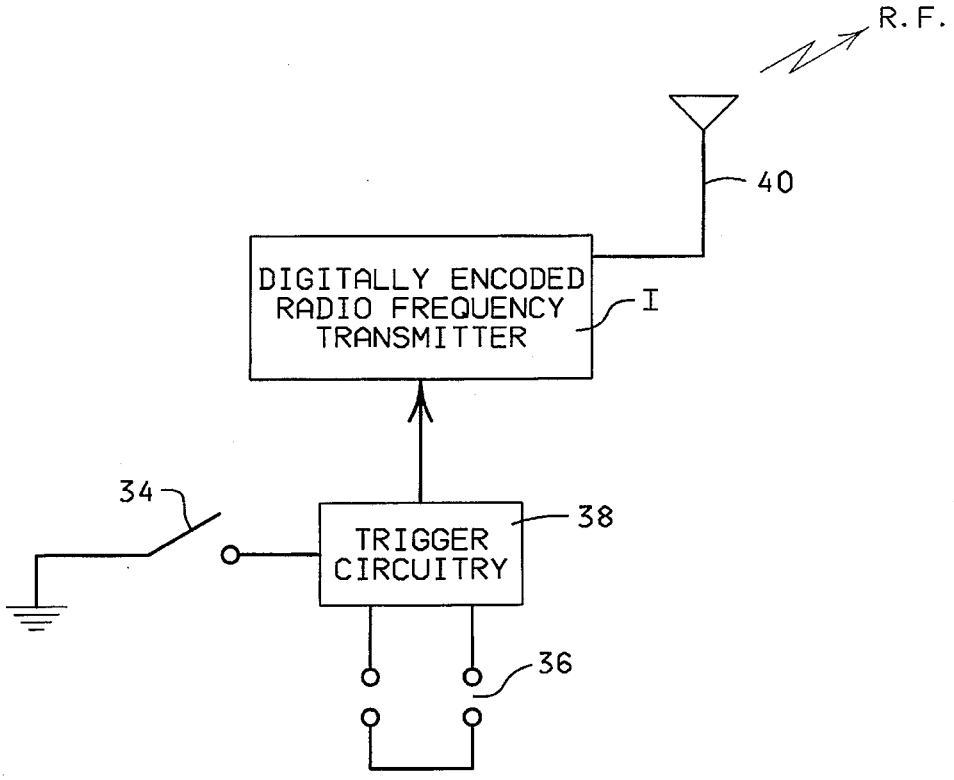
FIG. 4 is a block diagram relating to a radio frequency transmitter employed in enabling an unsanitary signaling light on a name tag.

As shown in FIG. 4, the digitally encoded radio frequency transmitter I may be enabled by either a magnetically operated door switch 34 associated with the door leading to a sanitation area, or by a shorting plug 36, each of which enables the transmitter I through suitable trigger circuitry 38 in a manner well known in the art. The switch 34 would be mounted to momentarily enable the transmitter I each time the door to the sanitation area is opened; whereas the shorting plug would provide an intermittent operation of the transmitter I, such as enabling the transmitter I for one second every thirty seconds.

The transmitter I is, as previously stated, a radio frequency type operating with a carrier frequency of, for example, 49 or 72 MHZ, and a field strength of less than, for example, 10,000 microvolts/meter at 3 meters. The actual field strength required is less than the maximum permitted by the Federal Communications Commission. The field strength is adjustable by selecting the effective length of the antenna 40 of the transmitter. A circuit such as provided by National Semiconductors LM 1871, obtainable from National Semiconductor, 2900 Semiconductor Dr., Santa Clara, Calif. 95052-8090, may be used and provides a digitally encoded (6 channel) R.F. signal.

Figure 5:
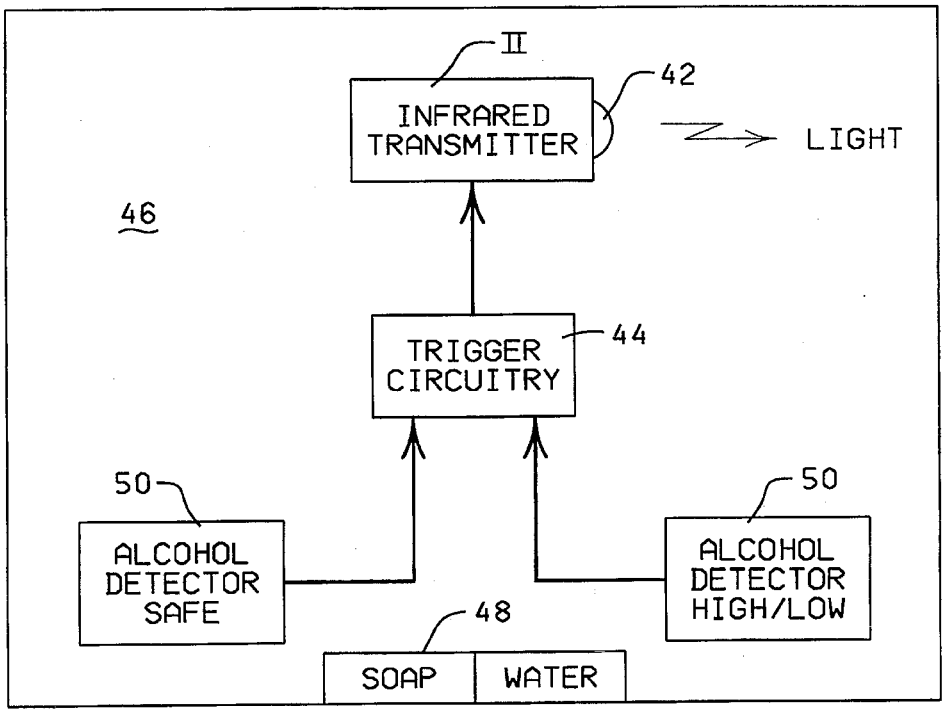
FIG. 5 is a block diagram of an infrared transmitter employed in disabling the unsanitary signaling light when a person has washed his/her hands with soap and water.

As shown in FIG. 5, the output of the infrared transmitter II is through a suitable lens 42, and the transmitter II is enabled and disabled by suitable trigger circuitry 44 as will be well known to those skilled in the art. As previously mentioned, the transmitter II will be mounted in association with the hand dryer 46 in the rest room or other sanitation area and arranged such as to transmit an infrared signal to the receiver 14 in the name tag 10 when a person is drying his or her hands at the hand dryer. The light output of the transmitter II is modulated with, for example, a 32.7 KHZ carrier and pulse code modulation to improve the signal to noise ratio and eliminate false triggering of the infrared receiver 14 on the name tag 10.

A suitable soap dispenser 48 will be provided adjacent the hand dryer 46 to contain a soap mixture containing a detectable gas emitting substance, such as alcohol. As the person using the sanitation facilities dries his/her hands with the hand dryer, the gas emitted from the person's hands will be suitably detected to enable the transmitter II when that concentration is within a safe range. For example, when the gas emitting substance is alcohol, the safe concentration levels will be in the range of about 50 to about 1,000 parts per million. Thus, a person will have difficulty circumventing the required hygienic procedures as, for example, by not using soap during the hand washing procedure. In other words, if the person using the facilities does not perform the hand washing operation in an acceptable manner, the unsanitary signaling light 26 will not be disabled when the persons hands are being dried.

When the detectable gas emitting substance is alcohol, the trigger circuitry 44 can be initiated by one or more alcohol detectors 50, such as Model 12 LG manufactured by the Davis Instrument Mfg. Co., Seton Business Center, 4701 Mt. Hope Dr., Baltimore, Md. 21215. With this arrangement, one of the detectors 50 may be adjusted to detect the alcohol concentration in the safe range to enable the trigger circuitry 44, and the second alcohol detector 50 can be adjusted to respond to concentrations above and below the safe range to disable the trigger circuitry 14 and prevent the transmitter II from being enabled.

Changes may be made in the combination and arrangement of parts or elements, as well as steps and procedures, heretofore set forth in the specification and shown in the drawing without departing from the spirit and scope of the invention as defined in the following claims.

We claim:

1. A system for encouraging workers in a hygienically controlled area to wash their hands before exiting an associated sanitation area, comprising:

a name tag for each worker;

a clear signaling light on each name tag;

an unsanitary signaling light on each name tag;

means for enabling the unsanitary signaling light on a name tag when the worker wearing the name tag enters the sanitation area; and means for disabling the unsanitary signaling light to indicate that said worker has likely washed his/her hands with soap and water, and then enabling the clear signaling light on said name plate.

2. A system as defined in claim 1 wherein the first mentioned means includes a first transmitter positioned in the sanitation area, and a compatible receiver on each name tag.

3. A system as defined in claim 2 wherein said first transmitter is a digitally encoded transmitter.

4. A system as defined in claim 2 characterized further to include means for enabling the first transmitter intermittently.

5. A system as defined in claim 2 characterized further to include means for enabling the first transmitter for a predetermined time period when a worker enters the sanitation area.

6. A system as defined in claim 2 wherein the first transmitter is a radio frequency transmitter.

7. A system as defined in claim 6 wherein the first transmitter is a digitally encoded transmitter.

8. A system as defined in claim 1 wherein the second mentioned means includes a soap mixture in the sanitation area having a dilute concentration of a detectible gas emitting substance therein.

9. A system as defined in claim 8 wherein said substance is alcohol.

10. A system as defined in claim 8 characterized further to include a water supply and a hand dryer in the sanitation area adjacent the soap mixture;

a second transmitter; and a detector means associated with the hand dryer and the second transmitter responsive to said detectible gas for enabling the second transmitter.

11. A system as defined in claim 10 wherein said detector means enables the second transmitter only when it detects a concentration of said detectible gas within a preselected range.

12. A system as defined in claim 11 wherein said preselected range is selected to more assuredly indicate the worker has washed his/her hands with soap and water.

13. A system as defined in claim 11 wherein said substance is alcohol and said range is between about 50 and about 1,000 parts per million.

14. A system as defined in claim 1 wherein the second mentioned means includes means for preventing the first mentioned means from reenabling the unsanitary signaling light for a predetermined period of time and after the unsanitary signaling light has been disabled, whereby the said worker has time to exit the sanitation area.

15. A system as defined in claim 1 wherein the clear signaling light includes a green light emitting diode.

16. A system as defined in claim 1 wherein the unsanitary signaling light includes a red light emitting diode.

17. A method for encouraging workers in a hygienically controlled area to wash their hands before exiting an associated sanitation area comprising the steps of:

attaching a name tag on each worker having a clear signaling light and an unsanitary signaling light thereon;

enabling the unsanitary signaling light when a worker wearing one of said name tags enters the sanitation area; and disabling the unsanitary light signal and enabling the clear signaling light signal indicating that said worker has likely washed his/her hands with soap and water in the sanitation area.

18. The method defined in claim 17 characterized further to include:

positioning a first transmitter in the sanitation area and a compatible receiver on each name tag for enabling the unsanitary signaling light on each name tag.

19. The method defined in claim 18 wherein the first transmitter is digitally encoded.

20. The method defined in claim 18 characterized further to include the step of enabling the first transmitter intermittently.

21. The method defined in claim 18 characterized further to include the step of enabling the first transmitter for a predetermined time period when a worker enters the sanitation area.

22. The method defined in claim 18 wherein the first transmitter is a radio frequency transmitter.

23. The method defined in claim 22 wherein the first transmitter is digitally encoded.

24. The method defined in claim 17 characterized further to include the step of locating a soap mixture in said sanitation area having a dilute concentration of a detectible gas emitting substance therein.

25. The method defined in claim 24 wherein said substance is alcohol.

26. The method defined in claim 24 wherein the sanitation area has a water supply and a hand dryer adjacent the soap mixture and wherein the method is characterized further to include the steps of:

locating a second transmitter in the sanitation area;

locating a detector in association with the hand dryer and the second transmitter; and enabling the second transmitter when the detector senses a given concentration of said gas.

27. The method defined in claim 26 characterized further to include a step of:

enabling the second transmitter only when the detector detects a concentration of said detectible gas within a preselected range.

28. The method defined in claim 27 wherein said range is selected to more assuredly indicate that the worker has washed his/her hands.

29. The method defined in claim 27 wherein said substance is alcohol and said range is between about 50 and about 1,000 parts per million.

30. The method defined in claim 17 characterized further to include the step of preventing the re-enabling of the unsanitary signaling light for a predetermined period of time after the unsanitary signaling light has been disabled.

* * * * *